US006068113A

United States Patent [19]

Schmaling et al.

[11] Patent Number: 6,068,113

[45] **Date of Patent: *May 30, 2000**

[54] PORTABLE HUMIDOR

[75] Inventors: John J. Schmaling, Libertyville, Ill.; Michael J. Emoff, Trotwood, Ohio

[73] Assignee: Hollywood Products, Inc., Libertyville, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,664

[22] Filed: Feb. 5, 1997

Related U.S. Application Data

[60] Provisional application No. 06/034,626, Dec. 31, 1996.

[51] Int. Cl.[7] ..... B65D 85/12

[52] U.S. Cl. ..... 206/213.1; 206/263; 206/523; 312/31.1

[58] Field of Search ..... 150/123, 124, 150/127, 130; 190/119–121, 124, 125, 127; 206/242, 261–263, 204, 205, 213.1, 523; 312/31.1; 220/62.2; 383/97, 119

[56] References Cited

U.S. PATENT DOCUMENTS

| | | | |
|---|---|---|---|
| 907,412 | 12/1908 | Sargent . | |
| 964,699 | 7/1910 | Sargent . | |
| 1,268,163 | 6/1918 | Schneider . | |
| 1,268,164 | 6/1918 | Schneider | 206/265 |
| 2,018,551 | 10/1935 | Freling | 190/127 |
| 2,124,920 | 7/1938 | Lambooy | 206/581 |
| 2,244,984 | 6/1941 | Davis | 206/581 |
| 2,261,157 | 11/1941 | Holbrook | 206/581 |
| 2,541,525 | 2/1951 | Lewyt | 206/10 |
| 2,555,126 | 5/1951 | Greve | 206/523 |
| 3,273,779 | 9/1966 | Mykleby | 206/523 |
| 3,369,859 | 2/1968 | Cornelius | 21/61 |
| 4,273,223 | 6/1981 | Tomlinson | 190/125 |
| 4,337,859 | 7/1982 | Murphy et al. | 206/823 |
| 4,685,558 | 8/1987 | Filiz et al. | 206/235 |
| 4,964,509 | 10/1990 | Insley et al. | 206/204 |
| 5,474,162 | 12/1995 | Shyr et al. | 190/127 |
| 5,607,051 | 3/1997 | Espinosa | 206/213.1 |
| 5,803,247 | 9/1998 | Holmes et al. . | |
| 5,829,451 | 11/1998 | Barber . | |

FOREIGN PATENT DOCUMENTS

| | | | |
|---|---|---|---|
| 2599719 | 12/1987 | France | 206/256 |

OTHER PUBLICATIONS

"Herrington, The Enthusiast's Catalog", front and rear cover and p. 23, published by Herrington, Londonberry, NH 03052, at least as early as Dec. 26, 1996.

See Information Disclosure Statement regarding joint inventorship (Paper 13).

See accompanying information Disclosure Statement regarding prior art material used for lid lining. (Paper 13).

Photocopies of brochure for Hazel Advertising Division of America Trading and Production Corporation (ATAPCO) Washingon, Missouri 63090, published 1997.

*Primary Examiner*—Jim Foster

*Attorney, Agent, or Firm*—Roger S. Dybvig

[57] ABSTRACT

A portable humidor has a cedar cigar storage container formed from a lower housing and an upper lid hingedly connected thereto. A cover assembly having an outer surface of leather or other suitable durable protective material is secured to the cedar container. The cover assembly includes a zippered closure. When the storage container is in a closed position for travel, the zippered closure serves to entirely enclose the container within the cover assembly.

12 Claims, 10 Drawing Sheets

PORTABLE HUMIDOR

CROSS-REFERENCE TO RELATED APPLICATION

This application is a continuation-in-part of copending application Ser. No. 60/034,626, filed Dec. 31, 1996, of John J. Schmaling, Joel Simmons, and Michael J. Emoff.

FIELD OF THE INVENTION

This invention relates to portable storage cases for cigars and, more particularly, to portable cigar humidors.

BACKGROUND OF THE INVENTION

Portable cigar humidors are known, an example of which, called "Pheasant's Leather Humidor", is shown on page 23 of *Herrington, The Enthusiasts' Catalog*, published 1996 by Herrington of Londonberry, N.H. 03052. The Pheasant Leather Humidor appears to comprise a box covered by leather and having a cedar lining. A humidistat is centrally located in a cedar panel recessed in the lid of the humidor. A leather strap with a male snap-fastener part is attached to the lid and cooperates with a female snap-fastener part on the front of the box.

SUMMARY OF THE INVENTION

An object of this invention is to provide a portable cigar humidor of a durable construction which can be inexpensively manufactured, which has a pleasing appearance, and which retains cigars completely within a humidified, cedar housing.

Another object of this invention is to provide a portable cigar humidor achieving the foregoing object which prevents unwanted movement of the cigars within the humidor during travel.

In accordance with this invention, a cigar container which is preferably made in two body parts from cedar, namely a lower part or housing and an upper part or lid. Both parts have a rectangular framework including mutually opposing side pieces connected at their ends to the ends of mutually opposing front and rear pieces. A top panel is connected to the top surfaces of the lid framework and a bottom panel is connected to the bottom of the housing framework. The frame pieces can be connected to one another in any suitable manner, preferably along surfaces that form mitered joints, such as by a suitable adhesive or by mechanical means such as screws, wavy plates, dowels, or nails. The top panels and bottom panels can be connected to their respective frames by any of various means, such as adhesives, nails, wavy plates or screws. The rear frame members are connected to one another by hinges which, preferably, function to enable the lid framework to lie flush on the housing framework when the container is closed. A flange is formed on the inside surfaces of one of the frameworks—preferably the lower, housing framework—that is partly bounded by the other framework when the container is closed, so as to substantially seal the cigar enclosure from outside air. A humidistat is adhered to the center of the lid panel. The mounting for the humidistat can be conventional, utilizing a magnet glued to the lid panel so that the humidistat can be easily removed to moisten its sponge and easily replaced.

The lid may advantageously be provided with a foam plastic liner having a circular cut-out for the humidistat, and having integral, downwardly-extending projections for engaging cigars in the housing to keep them from moving around and potentially being damaged. A hygrometer may be optionally provided, either affixed to the lid panel or the housing panel.

Further in accordance with this invention, the cedar container is enclosed in a cover assembly secured thereto and comprising a sheet of covering material such as leather, a plastic material that simulates leather, or other woven or unwoven fabric or plastic sheet material. The cover assembly preferably further includes a pair of reinforcement panels, which are preferably made of cardboard but could be made of fiberboard, wood or other materials, and which are preferably slightly larger in length and width than the container lid and box housing. When the container is closed, the reinforcement panels are substantially flush with the respective lid and housing panels and, accordingly, are separated by the thickness of the box. The covering material is wrapped around the side and front edges of both reinforcement panels and extends from the front of one reinforcement panel, across the rear of the box, to the front of the other reinforcement panel. The portion of the covering material spanning between the rear edges of the reinforcement panels is preferably provided with a flexible reinforcement to form therewith a flexible spine.

The cover assembly also includes a zippered, flexible webbing that is connected to the outer covering material and extends alongside the outer front and side surfaces of the housing and the lid. The zipper may be closed to join the portion of the webbing covering the housing to the portion of the webbing covering the lid, whereby the cigar container is enclosed entirely within the cover assembly and thus protected from damage during travel.

DETAILED DESCRIPTION

Figure 1:
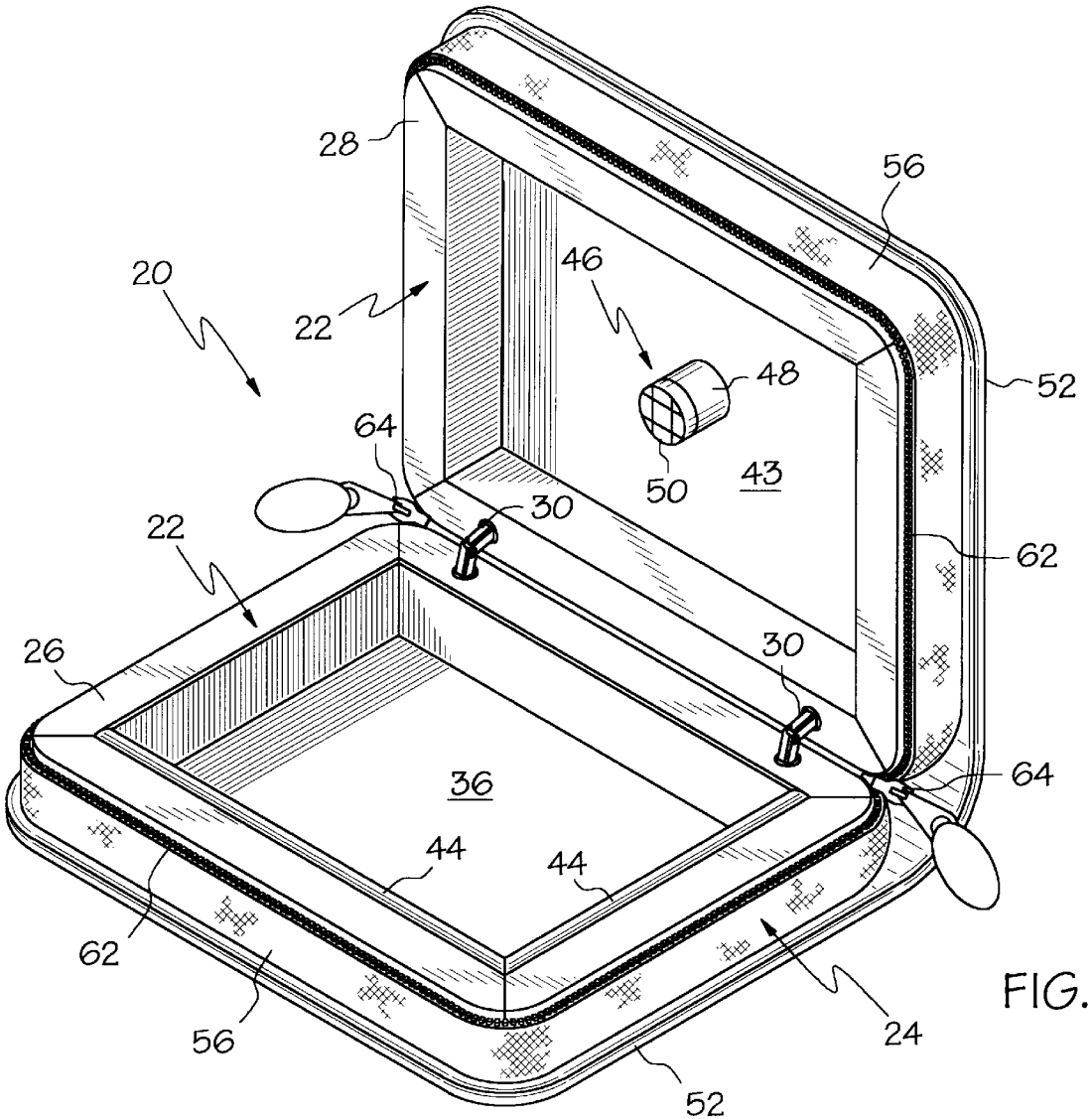
FIG. 1 is a perspective view of a portable cigar humidor in accordance with this invention showing the humidor in an open position.

FIGS. 1 through 6 illustrate a first embodiment of a portable humidor, generally designated 20, in accordance with this invention. The humidor 20 comprises a cigar storage container, generally designated 22, and a cover assembly, generally designated 24. Preferably, the storage container 22 is formed from cedar wood, which enhances the character of cigars stored therein. Of course, other materials could be used to form the storage container 22.

Figure 2:
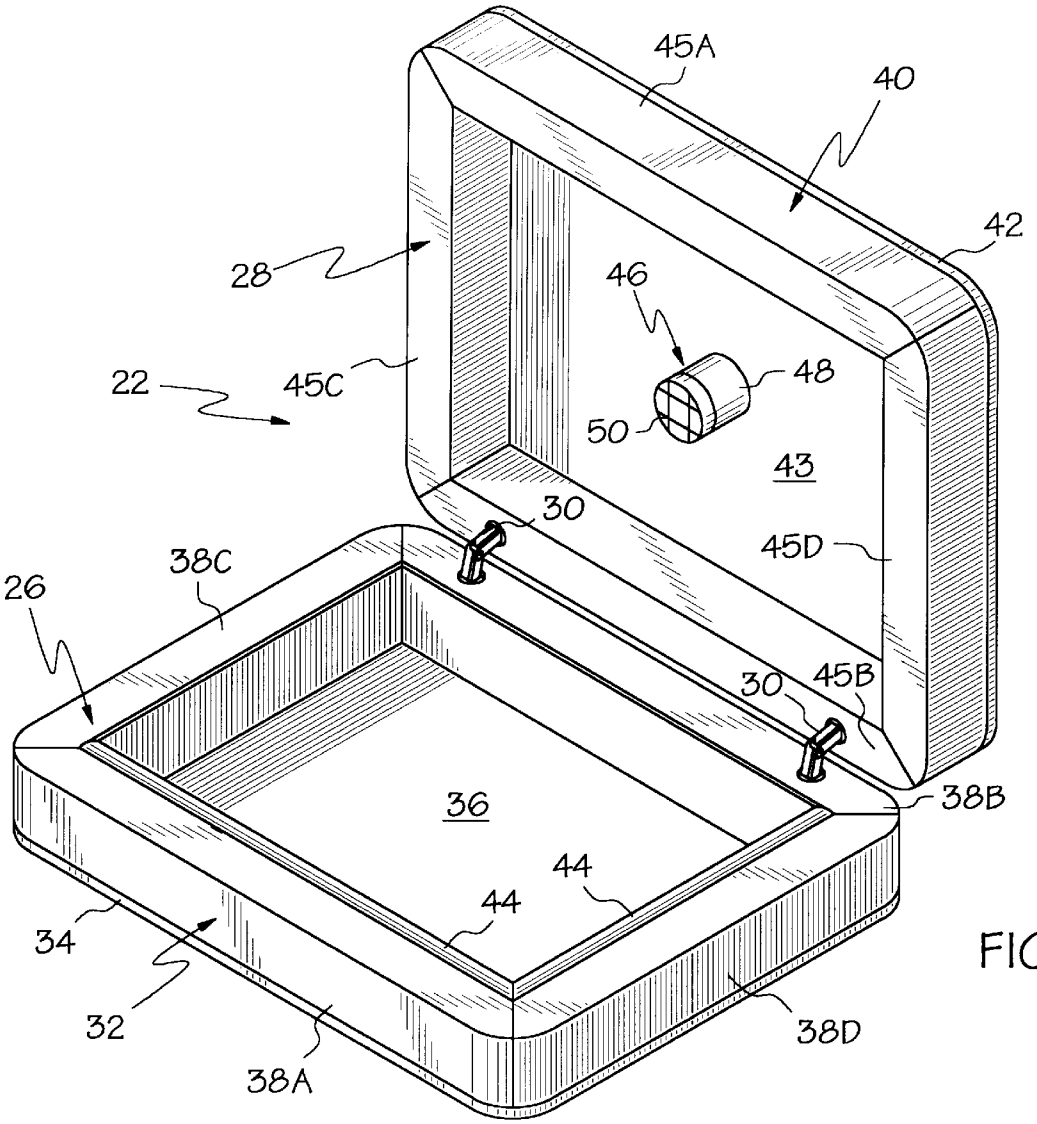
FIG. 2 is a perspective view of a cedar cigar container forming part of the portable humidor of FIG. 1 showing the cigar container in an open position.
Figure 5:
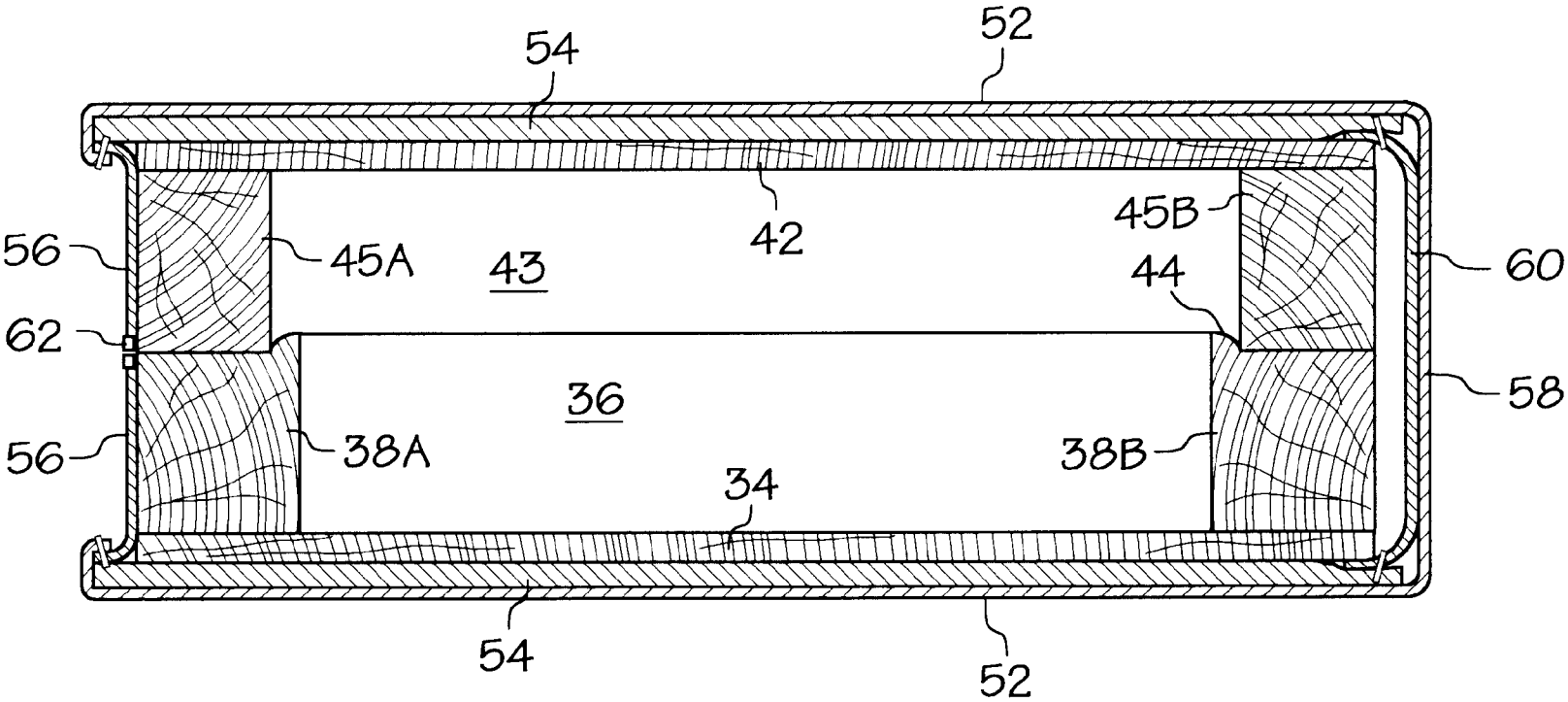
FIG. 5 is a cross-sectional view of the portable humidor of FIG. 4 taken along line 5—5 thereof.

With particular reference FIGS. 1 and 2, the storage container 22 is formed from a lower part or housing 26 and an upper part or lid 28. The housing 26 and the lid 28 are connected along their respective rear margins by a pair of hinges 30. The presently preferred hinges 30 are conventional, commercially-available barrel hinges, which are entirely hidden when the lid 28 is closed against the housing 26. It will be understood that the particular specifications of the hinges 30 depend on the dimensions of the container 22 and, therefore, are not discussed herein. The barrel hinges 30 permit the lid 28 to lie flush against the housing 26 when the container 22 is closed, as best seen in FIG. 5. It will be understood that other hinge configurations may be used to achieve the same result.

The housing 26 is formed from a housing framework 32 and a bottom panel 34 secured to the bottom of the housing framework 32 which cooperate to define a rectangular cavity 36 in the housing 26 for storing cigars. The housing framework 32 comprises four frame pieces 38, namely opposed front and rear frame pieces 38A and 38B and opposed side frame pieces 38C and 38D. The frame pieces 38 are connected to one another along mitered joints using a suitable adhesive, such as water-proof liquid resin glue (for example, Liquid Nails available from Macco Adhesives, Cleveland, Ohio 44115), or by mechanical means (not shown) such as screws, wavy plates, dowels, or nails, or both adhesive and mechanical means. The bottom panel 34 is preferably formed from a sheet of cedar plywood and is secured to the bottom of the housing framework 32 by adhesive or mechanical means, as described above with regard to the frame pieces 38.

The lid 28 is constructed similarly to the housing 26 and includes a lid framework 40 and a top panel 42 defining a rectangular cavity 43 in the lid 28. Likewise, the lid framework 40 is formed from four frame pieces 45, namely opposed front and rear frame pieces 45A and 45B and opposed side frame pieces 45C and 45D. For reasons discussed below, the cavity 43 in the lid 28 is proportional to the cavity 36 in the housing 26, but has a slightly greater outside dimension (i.e. perimeter) than the cavity 36.

With continued reference to FIGS. 1 and 2, the housing 26 is provided with an upstanding flange 44 extending around the entire margin of the cavity 36 in the housing 26. The flange 44 can be formed by any suitable method, such as by use of a router in the case of wood parts. Alternatively, the flange 44 could be formed from separate flange pieces suitably secured to the housing frame pieces 38. Because the cavity 43 is proportional to but has a slightly greater perimeter than the cavity 36, the flange 44 extending around the cavity 36 is received within the cavity 43 in the lid 28 when the lid 28 is closed against the housing 26, as best seen in FIG. 5. The flange 44 and the flush relationship between the housing 26 and the lid 28, when in the closed position, cooperate to substantially seal the cavity 36 from outside air, which serves to protect cigars stored in the cavity 36.

A humidistat, generally designated 46, is secured to the top panel 42 of the lid 28 and is located in the cavity 43 therein. As conventional, the humidistat comprises an absorbent, sponge-like foam plastic member, which is not readily visible in the drawings, located within a plastic housing 48 closed by a grate-like cover 50. As well known, the foam plastic member is kept suitably moist to maintain a desired humidity level within the humidor 10. Preferably, a strip of magnetic material (not shown) is secured to the humidistat housing 48 and a similar strip of magnetic material (not shown) is secured to the top panel 42, whereby the humidistat housing 48 can be readily secured to and removed from the lid 28 to re-moisten the foam plastic member within the humidistat housing 48. Of course, other suitable means could be used to detachably secure the humidistat 46 to the lid 28.

Figure 3:
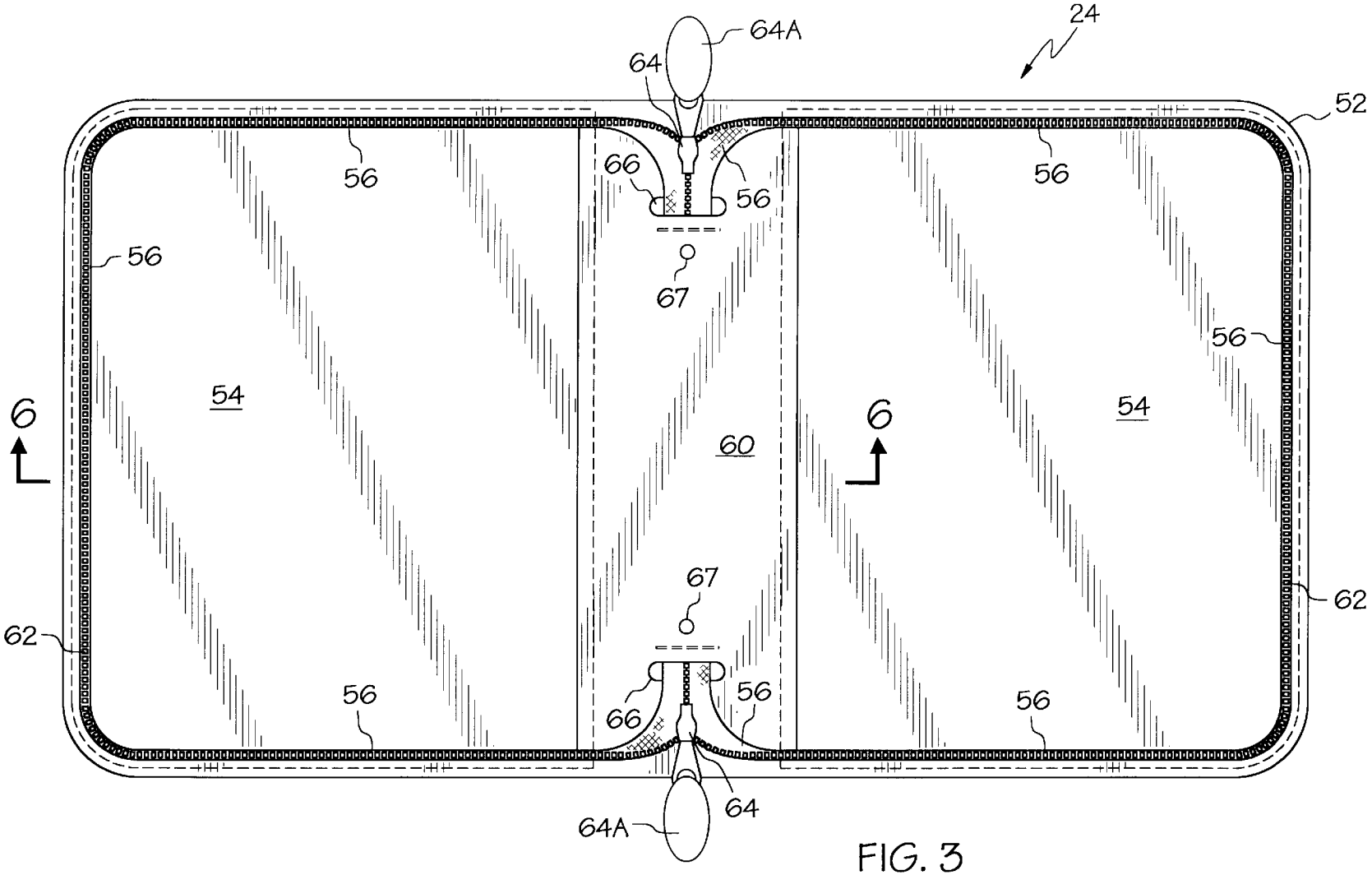
FIG. 3 is a plan view of a cover assembly forming a part of the portable humidor of FIG. 1.
Figure 6:
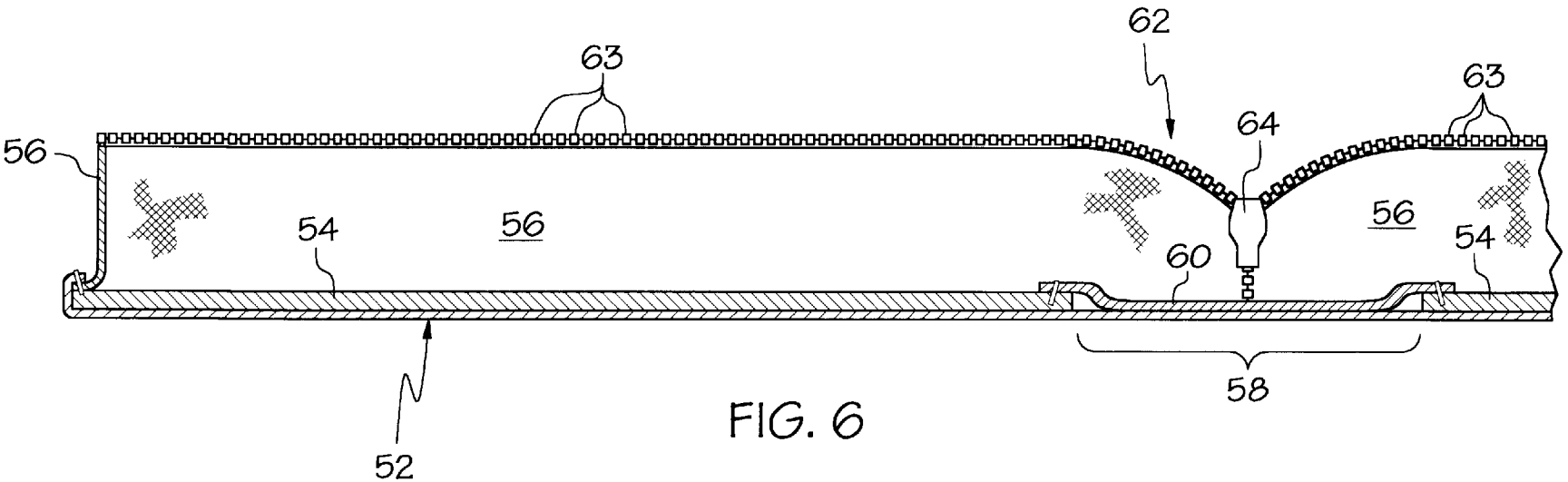
FIG. 6 is a fragmentary cross-sectional view of the cover assembly of FIG. 3 taken along line 6—6 thereof.

With reference to FIGS. 3, 5, and 6, the cover assembly 24 is formed from a generally rectangular outer cover 52 made from leather, simulated leather, woven or unwoven fabric, plastic sheet material, or other suitable flexible and durable material. In addition, the cover assembly includes a pair of mutually-spaced reinforcement panels 54, preferably made from cardboard, and a zippered webbing 56 made from a flexible material such as nylon. The cover assembly 24 is constructed by first layering the cover 52 on a flat surface and then placing the reinforcement panels 54 at mutually-spaced locations on the cover 52, the space between the panels 54 defining a flexible spine 58 of the cover assembly 24.

A spine reinforcement panel 60, which may be formed from the same material as the cover 52, is placed atop the spine 58 and is attached, as by sewing, to the reinforcement panels along confronting margins thereof. The webbing 56 extends around the outer margin of the reinforcement panels 54 and 60, and the outer portions of the cover 52 are rolled over and sewn to the reinforcement panels 54 and 60 with the margin of the webbing 56 trapped therebetween. As best seen in FIG. 3, the ends of the webbing 56 are joined by a conventional, two-way zipper 62 having teeth 63 which are drawn together or apart (i.e. meshed or unmeshed) by movement of sliding members 64, the joined ends of the webbing extending through notches 66 in the spine reinforcement panel 60. Each end of the webbing 56 is secured to the spine reinforcement panel 60 by sewing and by a rivet 67. For convenience, each of the zipper sliding members 64 has an enlarged tab 64A that may be grasped to move the sliding member 64.

Although the illustrated zipper 62 has two sliding members 64, it will be understood that a zipper 62 having a single sliding member may also be used. The use of a single sliding member 64 provides an advantage in that a user can tell from the location of the sliding member 64, when the humidor 20 is closed, which orientation is right-side up. In addition, a metal ring (not shown) or the like can be secured the cover assembly 24 in a well known manner, as by a conventional nylon loop (not shown) sewn to the spine area thereof, adjacent the end of the zipper 62 at which the sliding member is located when the zipper 62 is closed. Such ring can be used to attach a wrist strap (not shown) to the humidor 20, and a conventional lock (not shown) can be used to interconnect the ring and the single sliding member 64, thereby securing the contents of the humidor 20. Likewise, a lock could be used in a similar manner to interconnect the two-sliding members 64 of a two-way zipper 64 to secure the humidor 20.

A suitable cover assembly 24 as described above is available from the Hazel Division of American Trading and Production Corporation (ATAPCO), Washington, Mo. 63090, and can be custom manufactured to correspond to the particular size of the cigar container 22.

Figure 4:
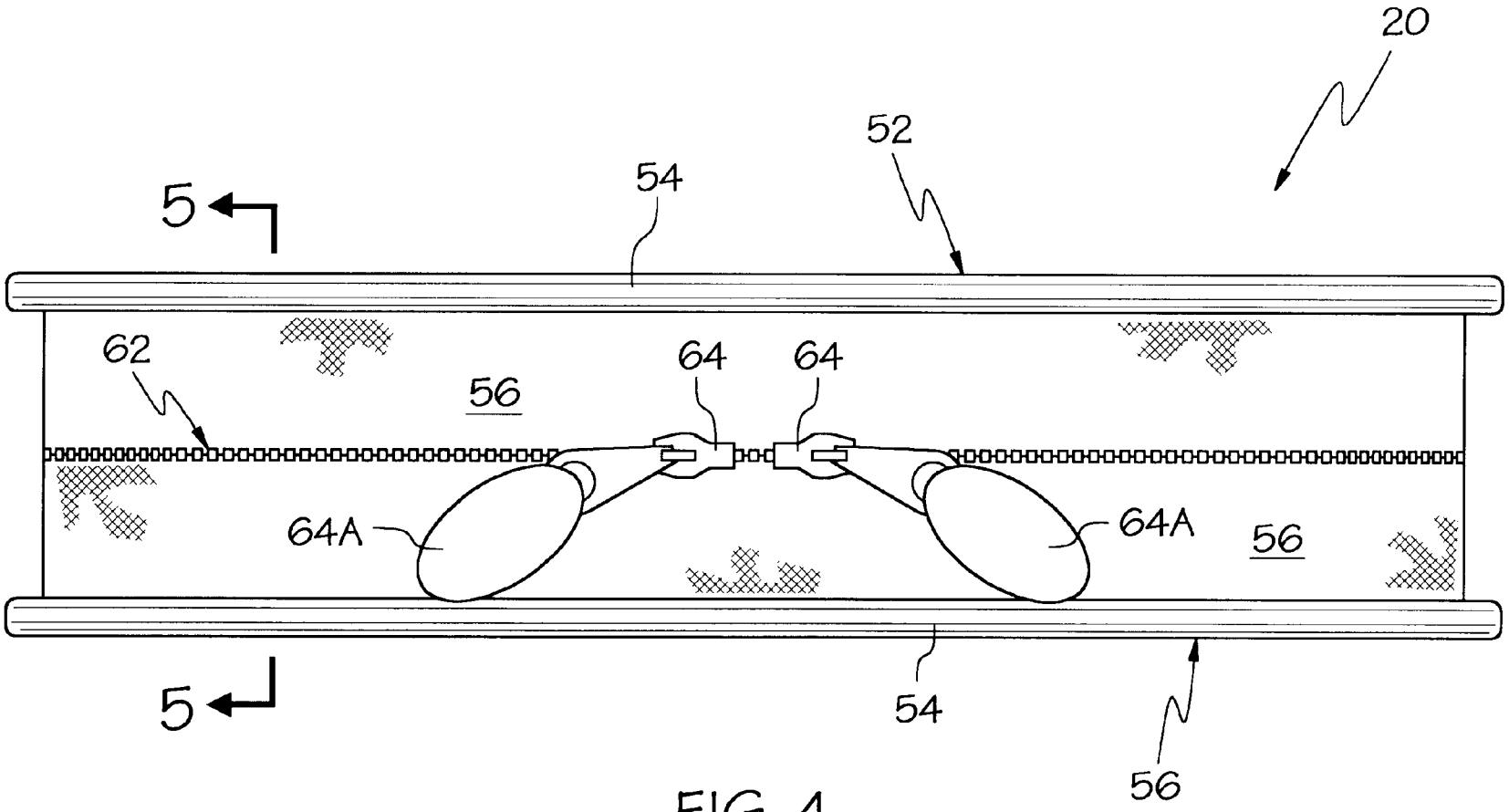
FIG. 4 is a front elevational view of the portable humidor of FIG. 1 showing the humidor in a closed position.

Referring now to FIGS. 1 and 5, the cover assembly 24 is secured to the cigar container 22 by use of a suitable adhesive, such as the liquid resin glue mentioned above. The bottom panel 34 of the housing 26 is secured to one of the reinforcement panels 24 of the cover assembly 54 and the top panel of the lid 28 is secured to the other reinforcement panel 54. The webbing 56 alongside the outer front and side surfaces of the frame pieces 38 and 45 forming the housing 26 and lid 28, respectively. The spine 58 of the cover assembly 24 covers the rear outer surfaces of the housing 26 and the lid 28. When the housing 26 and the lid 28 are in the closed position, the zipper 62 may be closed to join the webbing 56 covering the housing 26 to the webbing 56 covering the lid 28, as shown in FIG. 4, thereby enclosing the container 22 entirely within the cover assembly 24 for travel. When access to the stored cigars is desired, the zipper 62 is unzipped, and the lid 28 is pivoted to the open position shown in FIG. 1.

Figure 7:
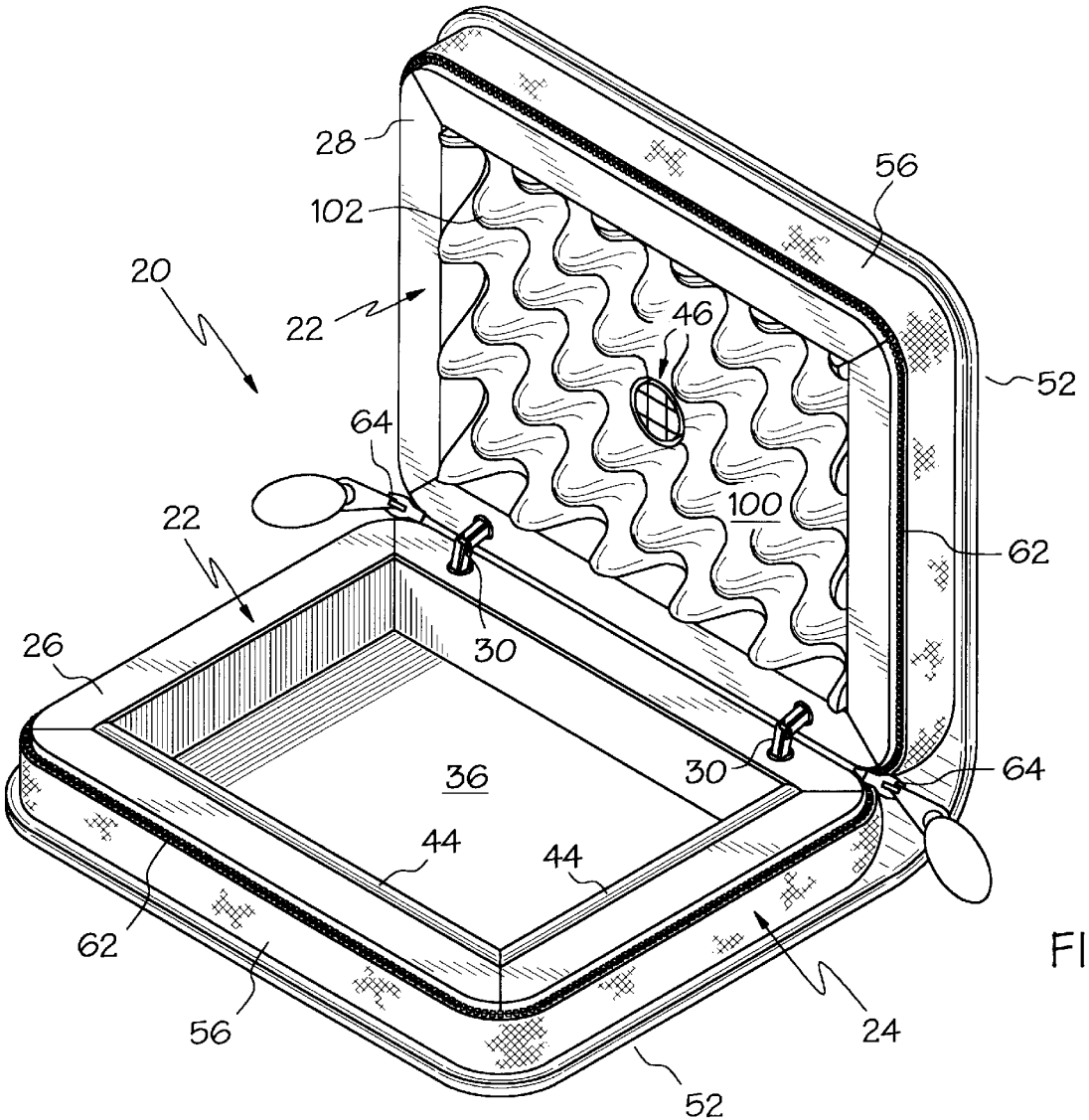
FIG. 7 is a perspective view similar to FIG. 1 but showing a second embodiment of a portable humidor in accordance with this invention.
Figure 8:
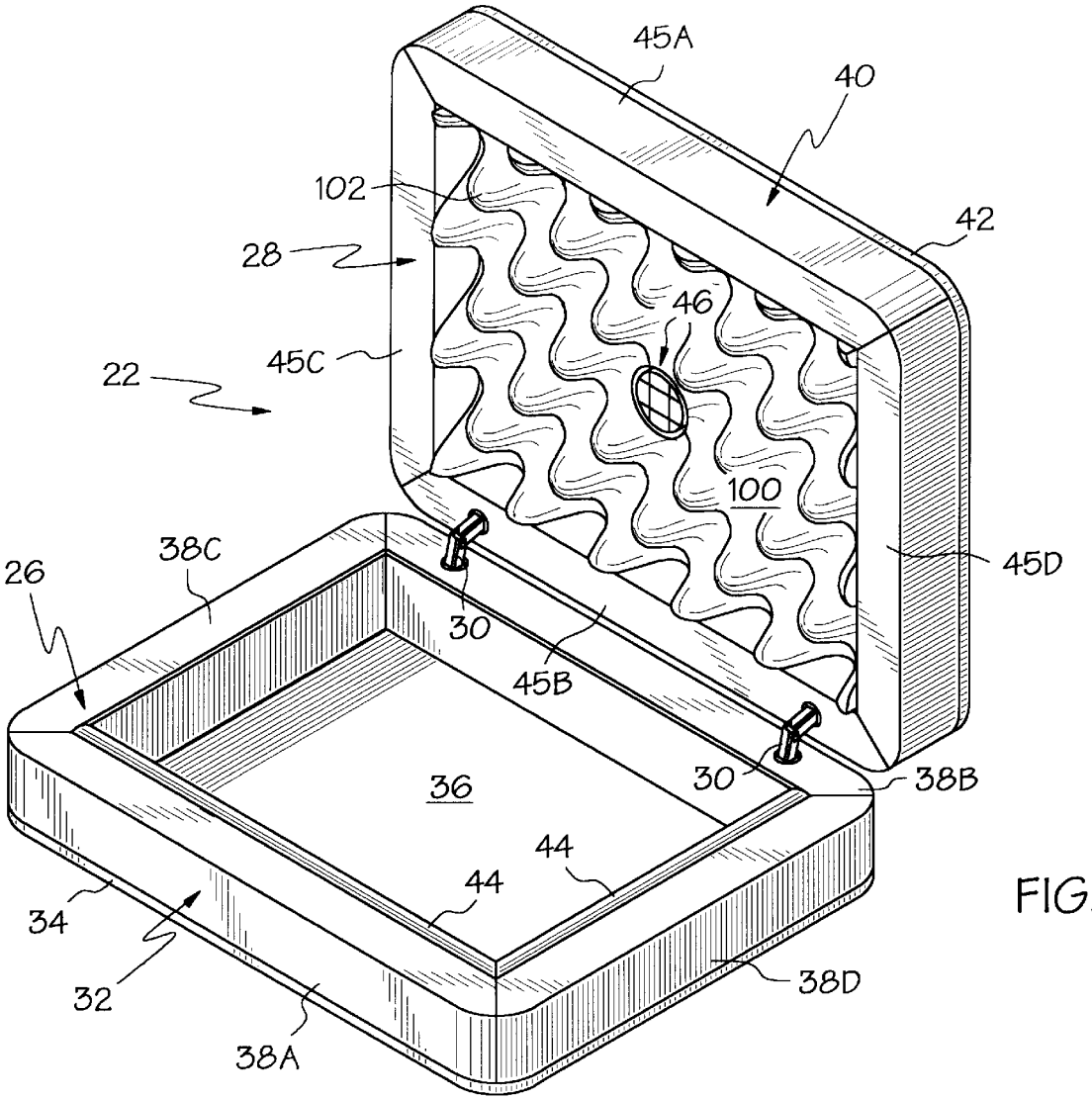
FIG. 8 is a perspective view similar to FIG. 2 but showing a cigar container forming a part of the portable humidor of FIG. 7.
Figure 9:
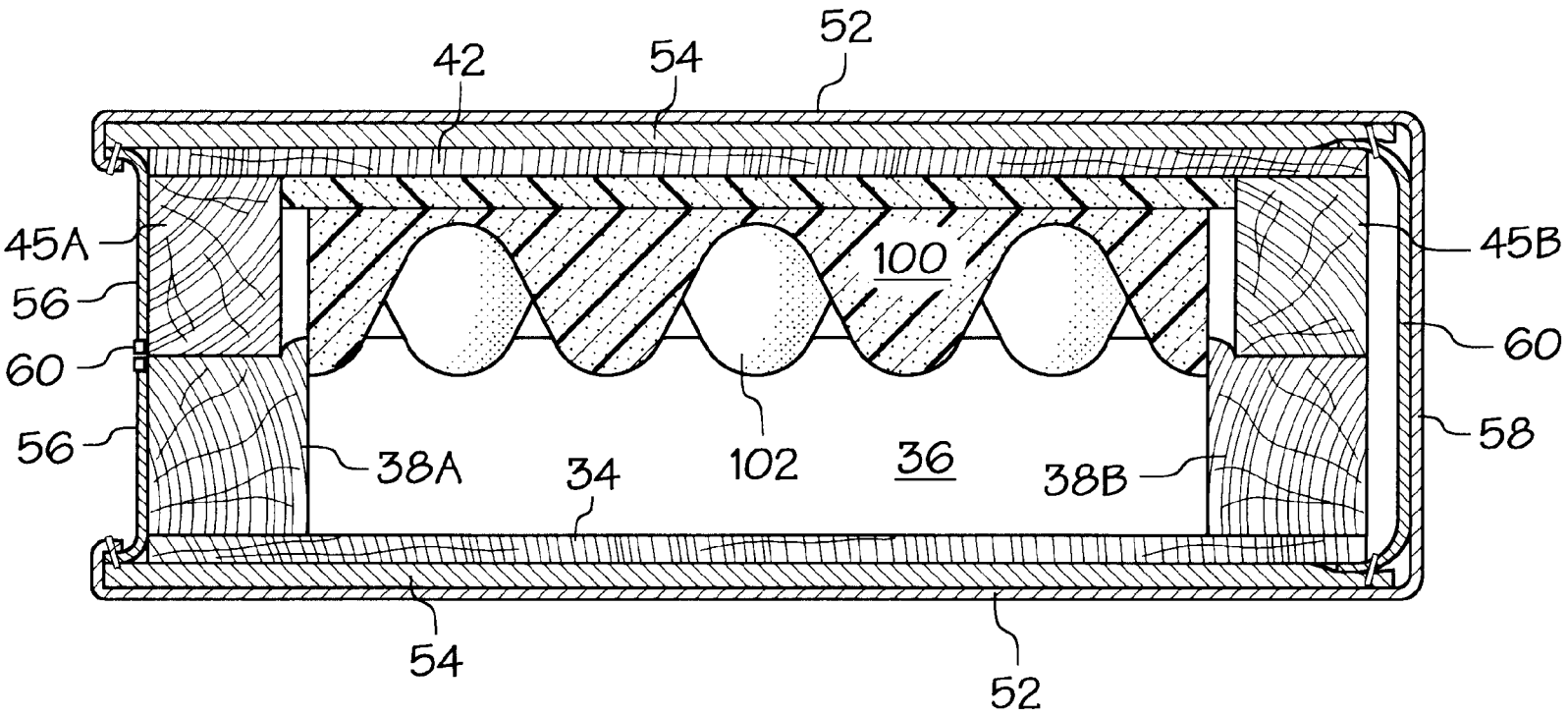
FIG. 9 is a cross-sectional view similar to FIG. 5 but showing the portable humidor of FIG. 7.

FIGS. 7 through 9 illustrate a second, preferred embodiment of a portable humidor in accordance with this invention. Because the second embodiment differs from the embodiment of FIGS. 1 through 6 in only one aspect, like reference numbers are used to refer to like parts.

Figure 11:
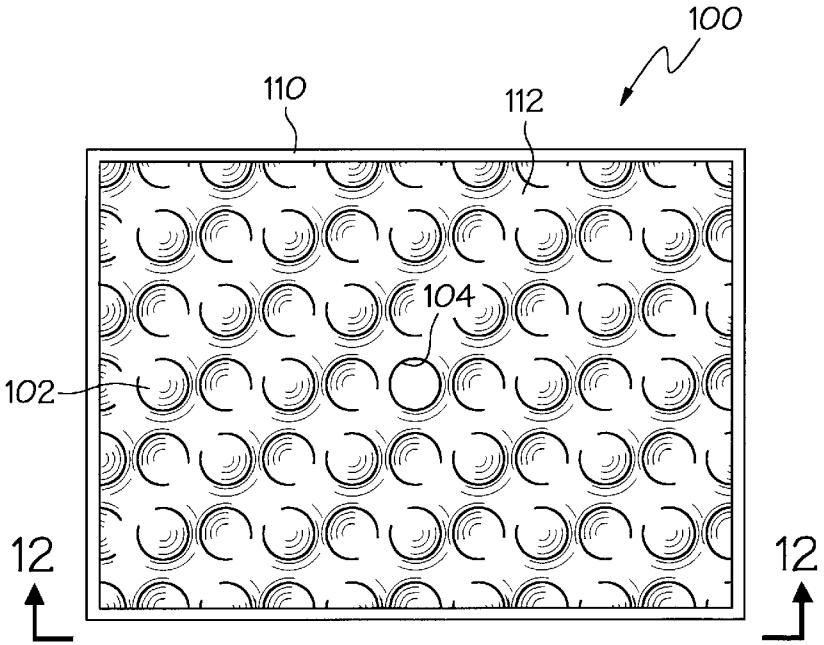
FIG. 11 is a plan view of the foam plastic liner of FIG. 10.
Figure 10:
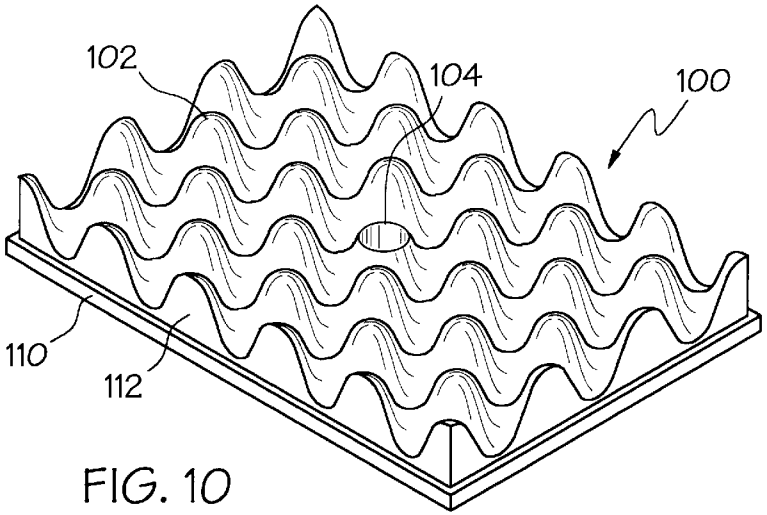
FIG. 10 is a perspective view of a foam plastic liner forming part of the portable humidor of FIG. 7.
Figure 12:
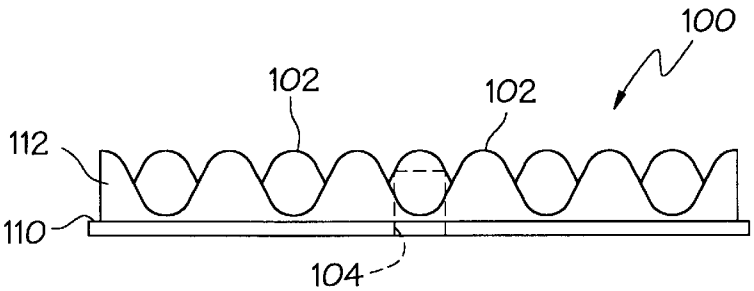
FIG. 12 is an elevational view of the foam plastic liner of FIG. 11 taken along line 12—12 thereof.

The humidor 20 shown in FIGS. 7 through 9 differs from the humidor of FIGS. 1 through 6 only in the addition of a foam plastic insert or liner, designated 100, secured within the cavity 43 in the lid 28. The liner 100, which is illustrated separately in FIGS. 10 through 12, is secured to the lid 28 by a suitable adhesive, such as double-sided adhesive tape, and has raised surface projections or contours 102 that extend into the cavity 36 in the housing 26 when the lid 28 is closed against the housing 26. Suitable foam plastic material is available from various suppliers, such as Special Design Products, 3755 Interchange Road, Columbus, Ohio 43204. The surface contours 102 of the foam plastic liner 100 engage the cigars located within the cavity 36 to prevent the cigars from moving around within the cavity 36, which might damage the cigars.

The liner 100 may be formed from a unitary piece of foam plastic material, in which case the preferred foam density is 1 pound per cubic foot. Preferably, however, the liner 100 is formed from two generally rectangular foam elements 110 and 112 secured together by a suitable adhesive, such as the aforementioned Liquid Nails adhesive, as shown in FIGS. 10 through 12. The dimensions of the perimeter of the foam element 110 are substantially the same as the dimensions of the perimeter of the cavity 43 in the lid 28, whereas the dimensions of the perimeter of the foam element 112 are slightly smaller and conform to the dimensions of the perimeter of the cavity 36 in the housing 28. In this two-piece construction, the foam element 110 is formed from non-contoured foam plastic material, and the foam element 112 is formed from convoluted foam plastic material as described above. Preferably, the foam element 112 has a density of 1 pound per cubic foot, whereas the foam element 110 is slightly more dense, having a density of 1.2 pounds per cubic foot.

The two-piece liner 100 is secured in the lid cavity 43, as described above, with the convoluted portion of the liner 100 confronting the cavity 36 in the housing 28 when the humidor 20 is closed, as shown in FIGS. 7 through 9. As best shown in FIG. 9, because the dimensions of the perimeter of the foam element 112 are only as large as those of the cavity 36 in the housing 28, the foam element 112 avoids unwanted contact with the flange 44 when the humidor 20 is closed. It will also be recognized that similar results can be achieved using a one-piece construction. Of course, if no flange 44 is provided and the cavities 36 and 43 have the same perimetric dimensions, the liner 100 need not have different perimetric dimensions at its upper and lower margins.

Although the use of a liner 100 having surface contours 102 configured as shown in FIGS. 7 through 12 is presently preferred, it will be understood that the use of a liner 100 having other suitable surface contour configurations is contemplated and should be deemed equivalent for purposes of this invention.

As shown in FIGS. 7 through 12, the liner 100 is provided with a circular cut-out 104 for the humidistat 46. A similar additional cut-out (not shown) would also be provided in the liner 100 if a hygrometer (not shown) is provided in the lid 28. If neither a humidistat 46 nor a hygrometer is provided in the lid 28, then no cut-outs 104 in the liner 100 would be necessary.

Although the presently preferred embodiments of this invention have been described, it will be understood that within the purview of the invention various changes may be made within the scope of the following claims.

Having thus described our invention, we claim:

1. A portable cigar humidor comprising:

a container including;

a housing comprising a bottom wall and opposed front and rear walls defining a cavity and;

a lid hingedly attached to said housing;

said housing and said lid having interfitting surfaces that cooperate to substantially seal said cavity from outside air; and a cover assembly secured to and covering said container, said cover assembly having a zippered closure so constructed that said container can be enclosed entirely within said cover assembly by closing said zippered closure.

2. The portable cigar humidor of claim 1 wherein said cover assembly has an outer cover comprising a material selected from the group consisting of leather, imitation leather, woven or unwoven fabric, and plastic sheet material.

3. The portable cigar humidor of claim 1 wherein said housing and said lid are formed from cedar wood.

4. The portable cigar humidor of claim 1 further comprising a humidistat secured to said lid.

5. The portable cigar humidor of claim 1 wherein said lid has resilient material secured thereto which engages and prevents movement of cigars stored in said housing.

6. The portable cigar humidor of claim 5 wherein said resilient material comprises foam plastic material.

7. The portable cigar humidor of claim 5 further comprising a humidistat secured to said lid.

8. The portable cigar humidor of claim 1 wherein said lid comprises a top wall and opposed front and rear walls.

9. The portable cigar humidor of claim 8 wherein each of said walls of said lid are made from wood.

10. The portable cigar humidor of claim 1 wherein each of said walls of said housing are made from wood.

11. The portable cigar humidor of claim 10 wherein said lid comprises a top wall and opposed front and rear walls.

12. The portable cigar humidor of claim 11 wherein each of said walls of said lid are made from wood.

* * * * *